United States Patent [19]

Appal et al.

[11] Patent Number: 4,962,864

[45] Date of Patent: Oct. 16, 1990

[54] TAMPER-EVIDENT AEROSOL CAP

[75] Inventors: Eugene R. Appal, Florissant; Michael A. Beiser; James P. McBroom, both of St. Louis, all of Mo.

[73] Assignee: Clayton Corporation, St. Louis, Mo.

[21] Appl. No.: 299,124

[22] Filed: Jan. 23, 1989

Related U.S. Application Data

[63] Continuation-in-part of Ser. No. 187,013, Apr. 27, 1988, abandoned.

[51] Int. Cl.[5] ..... B65D 17/34

[52] U.S. Cl. ..... 220/270; 220/266; 220/281; 220/85 P; 222/153; 222/182

[58] Field of Search ..... 220/85 P, 265, 266, 220/270, 306, 281; 215/253, 254, 255; 222/153, 182

[56] References Cited

U.S. PATENT DOCUMENTS

| | | | |
|---|---|---|---|
| 3,028,992 | 4/1962 | Bucher et al. | 220/270 |
| 3,128,004 | 4/1964 | Soffer | 220/285 |
| 3,170,602 | 2/1965 | Suellentrop, Jr. et al. | 222/182 |
| 3,170,603 | 2/1965 | Kitterman | 222/182 |
| 3,262,600 | 7/1966 | Gach | 220/284 |
| 3,414,167 | 12/1968 | Osrow | 222/182 |
| 3,480,184 | 11/1969 | Landis | 222/153 |
| 3,544,023 | 12/1970 | Hendrickson et al. | 220/270 |
| 3,684,124 | 8/1972 | Song | 220/270 |
| 3,802,607 | 4/1974 | Mead | 222/182 |
| 3,854,622 | 12/1974 | McKirnan | 220/306 |
| 3,964,634 | 6/1976 | Jasinski et al. | 220/281 |
| 3,995,765 | 12/1976 | Burke | 220/281 |
| 4,326,649 | 4/1982 | Marino et al. | 222/182 |

FOREIGN PATENT DOCUMENTS

| | | | |
|---|---|---|---|
| 2609901 | 9/1977 | Fed. Rep. of Germany | 222/182 |
| 6617413 | 6/1967 | Netherlands | 222/182 |

*Primary Examiner*—Stephen Marcus
*Assistant Examiner*—Nova Stucker
*Attorney, Agent, or Firm*—Sandler, Greenblum & Bernstein

[57] ABSTRACT

An aerosol cap which is tamper-evident. A portion of the bottom skirt must be torn away in order to remove the cap. The tear away section of cap is an independent member which when completely removed provides an unmistakable indication of tampering.

17 Claims, 1 Drawing Sheet

TAMPER-EVIDENT AEROSOL CAP

BACKGROUND OF THE INVENTION

This is a continuation-in-part of application Ser. No. 187,013, filed Apr. 27, 1988, now abandoned.

I. Field of the Invention

The invention relates to caps for aerosol containers. More particularly, the invention relates to caps which provide visual evidence of tampering.

II. Description of the Prior Art

Aerosol containers contain a valve member on their top surface. In order to protect the valve from accidentally activating, a cap is placed over the valve. The cap usually snaps over the valve's mounting cup.

Tampering with aerosol containers has become a major problem in recent years. A number of states have passed or are considering requiring manufacturers to employ tamper-proof or tamper-evident closures on aerosol products. Almost all manufacturers have elected to use tamper-proof systems.

These tamper-proof systems suffer a number of deficiencies. The most common deficiencies are that the containers are difficult to open or that the evidence of tampering is not readily evident at the time of purchase. Another serious problem is that the cap cannot be applied to the container with conventional manufacturing equipment.

An example of a tamer-proof system is illustrated in U. S. Pat. No. 3,170,603. In this system the cap is partially separated from a retaining skirt. The problem arises when the vandal resets the top in the same position as the other unopened cans. If the purchaser is not alert they will not notice until after they have purchased the product that the tampering has occurred.

There have also been proposals that require the release of circumferential strain along the cap rim to remove the cap. U. S. Pat. No. 3,262,600 is illustrative of this approach. As noted in the patent, even after the cap has been once removed it can be replaced to an operable condition. The skirt shoulders do not themselves lock on to the head of the container. Instead the skirt shoulders simply provide a means of releasing strain on the cap locking mechanism. If the shoulders were completely removed by a vandal it would be unobvious that the cap had been previously removed. The sole purpose of the shoulders is to maintain tension on the cap locking mechanism.

A third method of manufacturing a tamper proof cap is shown in U.S. Pat. No. 3,170,602. This method employs a tear tab. The bottom section of the cap is scored to facilitate the removal of the lower section of the cap. A significant disadvantage of such a system is that it is not obvious to a consumer whether the cap has been altered. There is no indication provided by the cap of tampering.

A fourth proposal is illustrated by U.S. Pat. No. 3,480,184. Since the cap has a continuous rib along its bottom surface for mating with a corresponding rib on the container, it is impossible to apply without either special equipment or heat. Both are expensive and undesirable.

An objective of the present invention is to provide a tamper evident aerosol cap. A second objective of the invention is to provide a cap which cannot be removed without removing at least a portion of the tamper evident seal. A final objective of the invention is to provide a cap which does not require special means of application or removal.

SUMMARY OF THE INVENTION

A tamper-evident cap comprising a top member and a skirt containing a lug member on its bottom surface wherein no more than 15% of the skirt is comprised of a tear away section. The invention further comprises such a cap in conjunction with a container.

DESCRIPTION OF THE PREFERRED EMBODIMENTS

Figure 1:
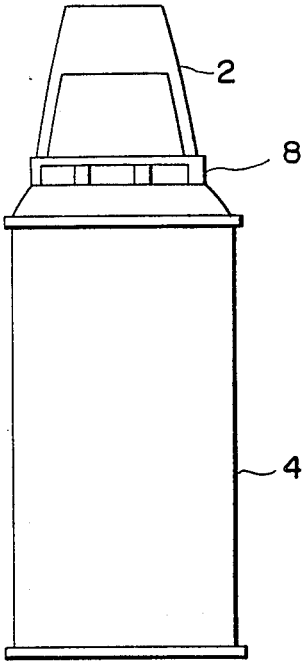
FIG. 1 is a front view of a container containing the cap of the invention.

As shown in FIG. 1, a cap 2 fits over the top of a container. The cap 2 locks over the rim of the valve mounting cup. FIG. 2 through 7 illustrate that the cap 2 is comprised of a top cover member 6 and a skirt 8. The top cover member 6 is designed to fully cover the container valve.

The skirt 8 depends from the top cover member 6. The skirt 8 does not necessarily have to be distinguishable from the top cover member 6. The bottom of the skirt 8 contains a lug 10 which locks onto the underside of the valve's mounting cup rim. No more than 15% of the skirt is comprised of an independent removable section 14.

The independent removable member 14 is attached to the skirt 8 and top cover 6 at points 16, 18, 25, 26, 27 and 28. The independent removable member 14 also contains a lug 20 on its bottom surface. Two sections of the independent removable member 14, elements 22 and 24, overlap the skirt 8.

The cap 2 is made from plastic and can be snapped over the valve at room temperature. Once in place the cap cannot be removed without breaking the seals at points 16 and 25 and/or 18 and 27. At least one seal must be broken to remove the cap 2 from the container 4. The cap 2 can then be lifted off by squeezing on the cover 6 at points 29 and 30. To reattach the cap 2 it must be firmly gripped or snapped over the mounting cap rim.

Figure 3:
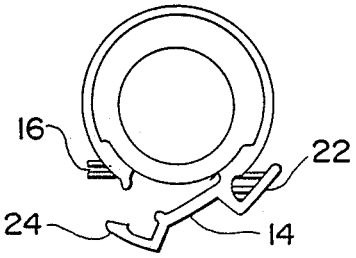
FIG. 3 is a top view of the cap of the invention with one side of the independent member torn away.

As shown in FIG. 3 the independent removable member 14 will act as a flag if any of the seal points 16, 25 and 26 or 18, 27 and 28 are broken. Due to the beading of the independent member 14 when a seal is broken and the cap removed, the independent member 14 cannot be rebent into its original position. Thus, a consumer will be alerted by the flag that the unit has been tampered.

Figure 7:
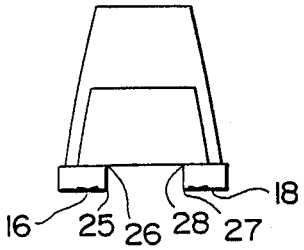
FIG. 7 is a sectional view through FIG. 4.
Figure 2:
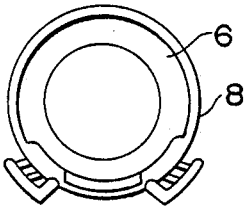
FIG. 2 is a top view of the cap of the invention.
Figure 4:
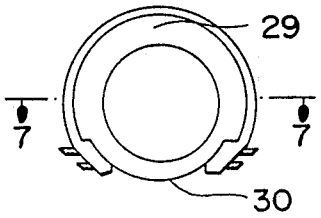
FIG. 4 is a top view of the cap of the invention with the independent member completely removed.
Figure 6:
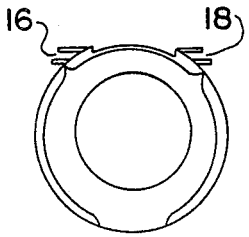
FIG. 6 is a bottom view of the cap of the invention which corresponds to FIG. 4.

If all seals 16, 25, 26 and 18, 27, and 28 are broken, as shown in FIGS. 4, 6, and 7, then the independent member 14 falls away from cap 2 and cannot be replaced in its original position. Thus a gaping hole is left in the skirt 8 which alerts the consumer as to the tampering. It should be noted that even with the independent member 14 removed, the remainder of lug 10 still functions to hold the cap 2 to the container 4.

Points 16, 18, 25, 26, 27 and 28 in the drawing indicate the various points along skirt 8 which will tear away from the skirt 8 when the independent member 14 is removed. When these points are broken the consumer is provided an unmistakable indication of tampering.

Figure 5:
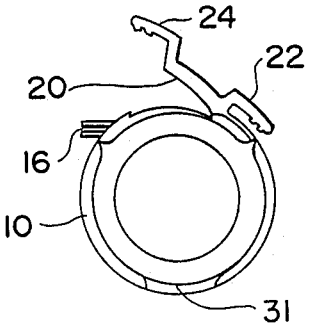
FIG. 5 is a bottom view of the cap of the invention which corresponds to FIG. 3.

As seen in FIGS. 5 and 6 the lug 10 is discontinuous to a point opposite the independent member 14. This discontinuous section 31 is critical in allowing the cap to be mounted upon the container 4 without heat or special equipment. This ability to use conventional packaging equipment is very important to commercial packers who would rather forego a tamper evident cap rather than incur substantial capital outlay for new equipment.

We claim:

1. A tamper-evident cap comprising a top cover member and a skirt containing a locking lug member, wherein a portion of said skirt comprises a removable tear away section and said locking lug member includes a discontinuous portion substantially diametrically opposed to said tear away section for permitting mounting of said cap on a container and removal by inwardly squeezing said top cover member.

2. The tamper-evident cap of claim 1 wherein at least a portion of said tear away section comprises an independent removable member.

3. The tamper-evident cap of claim 2 wherein at least a portion of said independent member overlaps said skirt.

4. The tamper-evident cap of claim 2 wherein at least a portion of said independent member is integral with said skirt.

5. The tamper-evident cap of claim 2 wherein said tear away section comprises no more than 15% of the skirt.

6. The tamper-evident cap of claim 2 wherein said independent removable member is attached to said skirt and cover member at spaced intervals.

7. The tamper-evident cap of claim 1 wherein said tear away section forms a flag.

8. The tamper-evident cap of claim 2 wherein said independent removable member contains a locking lug member.

9. A container having a tamper-evident cap which comprises a top cover member and a skirt containing a locking lug member, wherein a portion of said skirt comprises a removable tear away section and said locking lug member is discontinuous and substantially diametrically opposed to said tear away section wherein said top cover must be squeezed inward to remove.

10. A container having a tamper-evident cap which comprises a top cover member and a skirt containing a locking lug member, wherein a portion of said skirt comprises a removable tear away section and said locking lug member includes a discontinuous portion substantially diametrically opposed to said tear away section for permitting mounting of said cap on said container and removal by inwardly squeezing said top cover member.

11. The container of claim 10 wherein said tear away section comprises an independent removable member.

12. The container of claim 11 wherein at least a portion of said independent member overlaps said skirt.

13. The container of claim 11 wherein at least a portion of said independent member is integral with said skirt.

14. The container of claim 11 wherein said tear away section comprises no more than 15% of the skirt.

15. The container of claim 11 wherein said independent removable member is attached to said skirt and cover member at spaced intervals.

16. The container of claim 10 wherein said tear away section forms a flag.

17. The container of claim 11 wherein said independent removable member contains a locking lug member.

* * * * *